US005119519A

United States Patent [19]

Foreman

[11] Patent Number: 5,119,519

[45] Date of Patent: Jun. 9, 1992

[54] COMBINATION PILLOW AND TOTE BAG

[76] Inventor: Bryan C. Foreman, 12866 FM 346 West, Bullard, Tex. 75757

[21] Appl. No.: 683,447

[22] Filed: Apr. 4, 1991

[51] Int. Cl.[5] ..... A47G 9/00; A45C 9/00

[52] U.S. Cl. ..... 5/640; 5/645; 190/1

[58] Field of Search ..... 5/434, 437, 442, 491; 190/1, 107, 119, 124, 125, 127, 903

[56] References Cited

U.S. PATENT DOCUMENTS 2,618,790 11/1952 Ritchey ..... 5/437
3,041,638 7/1962 La Vico ..... 190/2 X
3,879,775 4/1975 Iwata ..... 5/442
3,998,304 12/1976 Edgerton, Jr. et al. ..... 190/107
4,157,134 6/1979 Stoll ..... 190/1

*Primary Examiner*—Michael F. Trettel
*Attorney, Agent, or Firm*—Ronald B. Sefrna

[57] ABSTRACT

A pillow and tote bag combination including two cushions and a durable soft collapsible sheath with a closable opening therein and handles attached thereto, interconnected between the cushions to form a convenient soft sided tote bag. One part of a two part separable zipper is interconnected to each cushion around its circumference, such that the sheath can be collapsed between the cushions, and the cushions joined together to form an attractive and functional pillow.

15 Claims, 3 Drawing Sheets

COMBINATION PILLOW AND TOTE BAG

FIELD OF THE INVENTION

The present invention generally relates to portable pollows or cushions, and in some of its embodiments more particularly relates to a pillow and tote bag combination having a pair of attachable cushions and a collapsible tote bag extending therebetween.

BACKGROUND OF THE INVENTION

There is an unfulfilled need in the field of the invention for a convenient, portable cushion or pillow device which is also useful for carrying various articles. Accordingly, it is among the objects of the invention to provide a pillow device which is conveniently portable and comfortable to use. It is further among the objects of the invention to provide a modern, attractive and spacious tote bag which can be readily reduced in size for compact storage when not in use. It is still further among the objects of the invention to provide a pillow and tote bag combination which is useful for carrying various articles and which can be collapsed to form a comfortable pillow. It is yet further among the objects of the invention to provide a pillow and tote bag combination which is waterproof and buoyant.

SUMMARY OF THE INVENTION

The present invention provides an attractive, modern, soft-sided, duffel-type tote bag designed to meet the needs of travelers, sportsmen and the like, which can be collapsed and secured to form a pillow that can be used for a variety of purposes and also provide for convenient storage when not in use. The invention generally comprises two cushions that form the ends of the tote bag, defining its shape and providing stability, and a flexible sheath extending between the two cushions to form the body of the tote bag. Each cushion includes a suitable covering and a filling of foam, fiber or any other suitable filling material. Each cushion further includes one part of a two part separable zipper, or other convenient closure means, extending around the circumference of the cushion and interconnected thereto so that when the two cushions are placed together and secured by joining the two parts of the zipper, a functional and attractive pillow is formed. Each end of the sheath is interconnected to a respective one of the cushions around the circumference thereof, so that when the zipper securing the cushions together in pillow form is released, the sheath is allowed to expand to form the body of a tote bag. The sheath forming the tote bag is provided with convenient strap-type carry handles and includes a closable opening for access to the interior of the tote bag. The handles are positioned so that, if desired, at least one handle may be pulled from between the cushions through an opening left between the two parts of the cushion zipper when the cushions are connected in the pillow configuration to provide a convenient carry handle for the pillow. Connection of the cushions in the pillow configuration also facilitates storage by minimizing the total storage space required.

The cushion coverings and the tote bag sheath can be formed of water repellent materials, and the cushion zipper or other closure means and/or the tote bag closure can be made water resistant so as to provide for reasonable water proofing of the pillow and the tote bag. The filling of each cushion may be made of buoyant material to provide floatation. The structure and features of the preferred and alternative embodiments of the invention will be described in more detail with reference to the accompanying drawing figures.

DESCRIPTION OF THE PREFERRED EMBODIMENT

Figure 1:
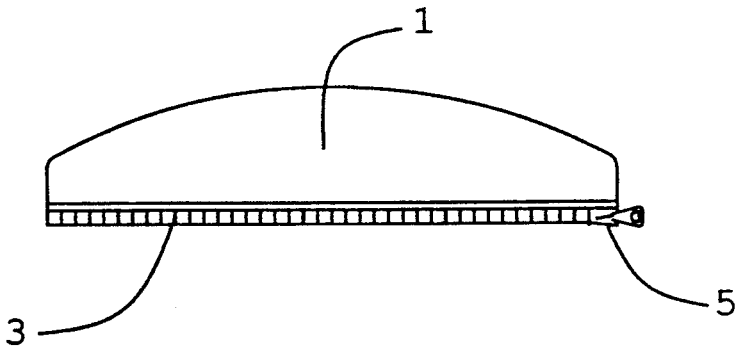
FIG. 1 is a view of a first cushion of the pillow and tote bag of the invention along a diameter line of the cushion, showing one part of a zipper closure attached thereto.
Figure 2:
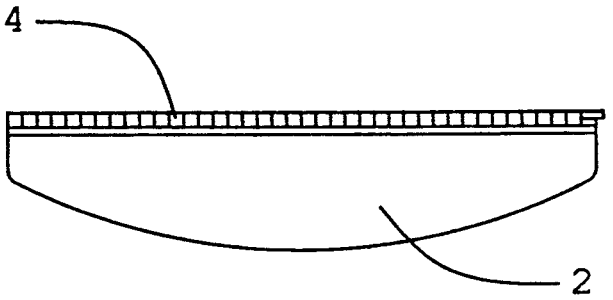
FIG. 2 is a view of a second cushion of the invention along a diameter line of the cushion, showing a second part of a zipper attached thereto.
Figure 3:
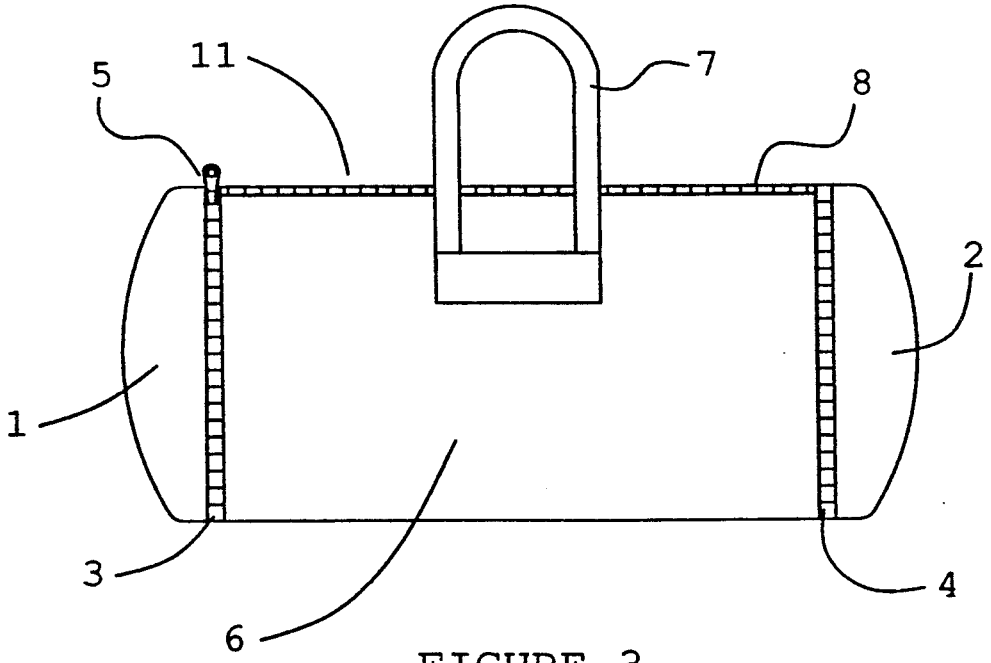
FIG. 3 is a side view of the invention, expanded to form a tote bag, showing handles and closure means.
Figure 4:
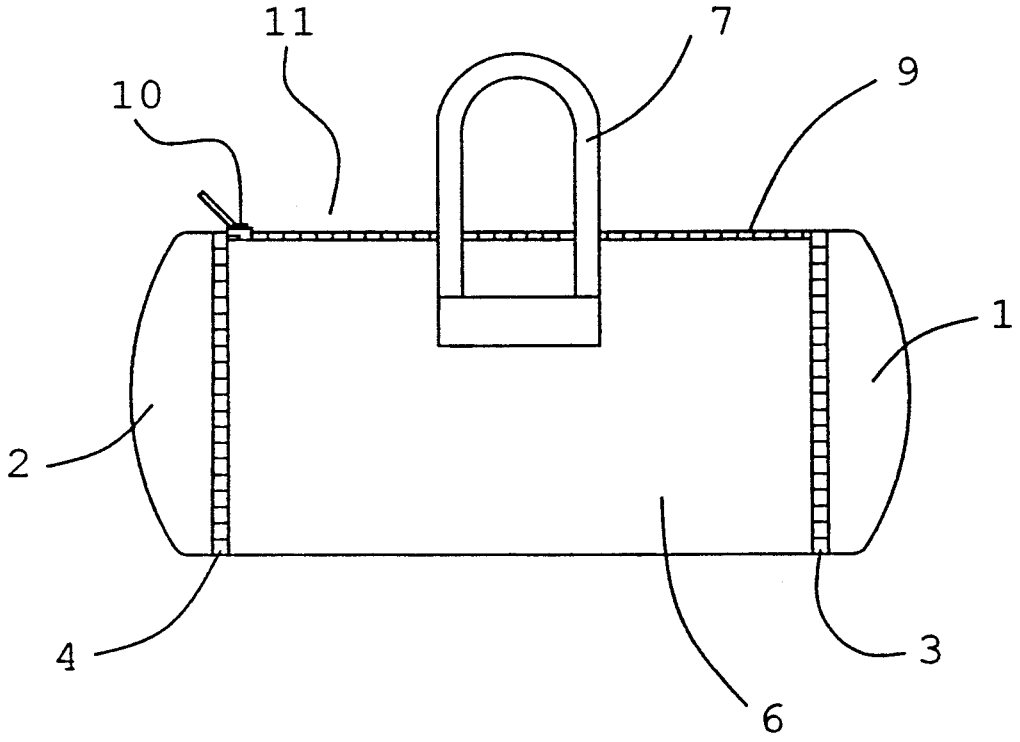
FIG. 4 is a side view of the invention, expanded to form a tote bag, from the side opposite that depicted in FIG. 3.
Figure 6:
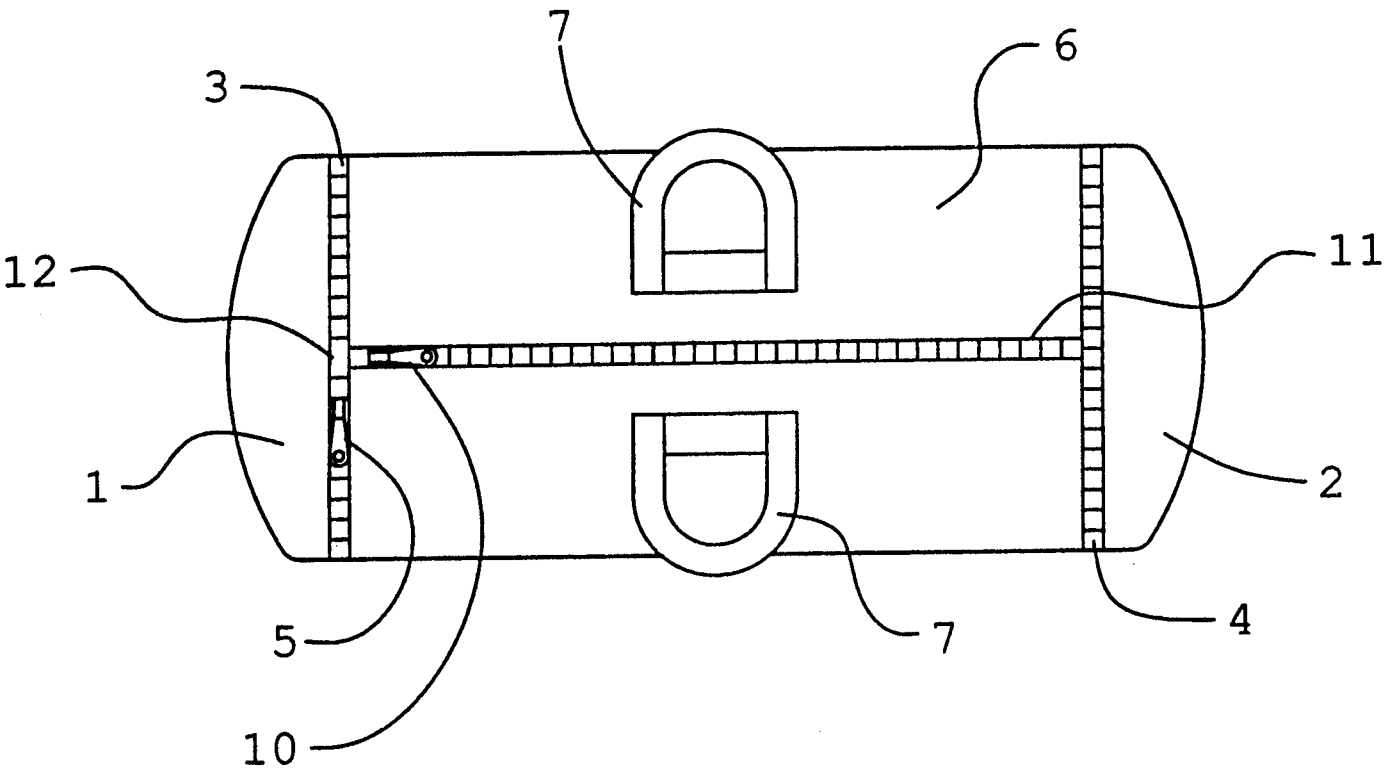
FIG. 6 is a top view of the invention, expanded to form a tote bag, showing handles and closure means.

With reference to the accompanying drawing figures, the pillow and tote bag of the invention is shown in FIGS. 3, 4, and 6 to generally comprise a pair of cushions, designated by reference numerals 1 and 2, and a flexible tubular sheath 6 connected between cushions 1 and 2. Cushions 1 and 2, which are generally identical in configuration and dimension, may be formed of any suitable natural or synthetic material, including various foamed or fibrous materials. It is preferred that the cushion material be washable and non allergenic. Each cushion is fully covered with a decorative covering formed of any suitable natural or synthetic material that is, or may become, available. As illustrated in FIGS. 1 and 2, each cushion of the preferred embodiment has a substantially flat first or inner face and a convex second or outer face. In the preferred embodiment, each cushion includes one part of a two part zipper assembly, extending around the outer edge or circumference of the respective cushion and interconnected thereto, so that the inner faces of the cushions may be brought together and the cushions releasably interconnected to form a comfortable and compact pillow. The zipper assembly of the preferred embodiment includes a first zipper segment 3, a second zipper segment 4, and a zipper closure device, or slider, 5. Each zipper segment has a first end and a second end, and is interconnected around the circumference of the respective cushion by any convenient means, such as stitching.

The flexible sheath 6 extends between cushions 1 and 2 and connects them together to form a hollow tote bag body and complete the structure of the pillow and tote bag combination. In the preferred embodiment of the invention sheath 6 is interconnected to each cushion by stitching. More specifically, in the preferred construction of the invention, the cover of each cushion is sewn over the cushion material with a seam extending around the circumference of each cushion, and the material of sheath 6 at each end thereof is incorporated into the respective cover material seam. It is preferred that the respective zipper segment for each cushion be interconnected by incorporating such zipper segment in the seam with their respective first and second ends aligned from one end of sheath 6 to the other, resulting in a single seam interconnecting the components associated with each cushion. It is also preferred that each seam be stitched from the inside of sheath 6 to provide a neat appearance.

In the preferred embodiment, sheath 6 includes a pair of handles 7, illustrated in FIGS. 3, 4, and 6, generally centered longitudinally on sheath 6 and interconnected thereto by stitching or other convenient means. Sheath 6 further includes access closure means, preferably in the form of a two part zipper assembly having a first zipper segment 8, a second zipper segment 9, and a zipper closure device, or slider, 10. Each of zipper segments 8 and 9 is interconnected, by stitching or other convenient means, to a respective edge of an access opening 11, with access opening 11 and zipper segments 8 and 9 extending longitudinally in sheath 6 between handles 7, as shown in FIG. 6. It is preferred that access opening 11 and the associated zipper assembly extend through the full length of sheath 6 between cushions 1 and 2, and that the ends thereof be aligned with the ends of cushion zipper segments 3 and 4. Access opening 11 is opened and closed by moving slider 10 along the line of the opening, respectively separating and joining zipper segments 8 and 9.

Figure 5:
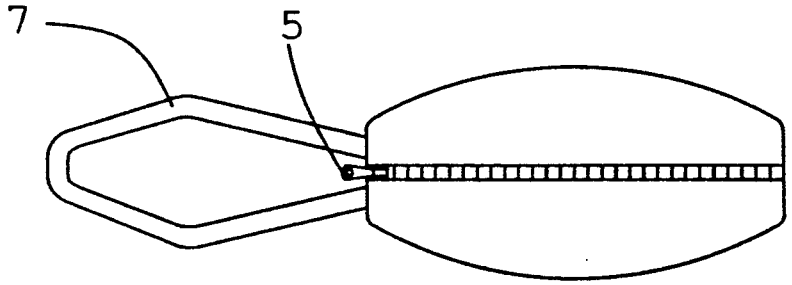
FIG. 5 is an edge view of the invention in pillow configuration with tote handles extended.

With sheath 6 fully extended, as shown in FIGS. 3, 4, and 6, the invention is configured as a soft sided tote bag. It is preferred that cushions 1 and 2 be constructed so as to be reasonably shape retentive, so that the cushions serve to define the shape of and provide stability to the tote bag formed by extended sheath 6. In the tote bag configuration, the invention may be used to carry or to store a wide variety of articles. When it is desired to use the invention in pillow configuration, sheath 6 is collapsed between cushions 1 and 2, and cushions 1 and 2 are brought together and secured by joining zipper segments 3 and 4 of the cushion zipper assembly with sheath 6 enclosed between the cushions. As shown in FIG. 5, one or both handles 7 may be pulled out through an opening 12 between the ends of the cushion zipper assembly to provide a convenient carry handle for the pillow.

The pillow and tote bag combination of the invention may readily be made buoyant and relatively waterproof by utilizing a buoyant material for the construction of cushions 1 and 2, by utilizing a water resistant fabric or other material for the construction of the cushion coverings and of sheath 6, and by utilizing a water resistant zipper assembly or other water resistant closure means to close access opening 11. It should be noted that although zippers are disclosed as the best mode of closure in the description of the preferred embodiment of the invention, other suitable closure means that are, or may become, available in the future may be utilized within the scope and spirit of the invention.

The foregoing description of the preferred embodiment of the invention is illustrative and not for purposes of limitation, and although certain alternative embodiments and modifications have been suggested, the invention is susceptible to various other modifications without departing from the scope of the invention as claimed.

The present invention may be carried out in other specific ways than these herein set forth without departing from the essential characteristics of the invention.

The present embodiments are, therefore, to be illustrative and not restrictive, and all changes coming within the meaning, and equivalency of, the range of the claims are intended to be embraced within, and so what I claim to be new and different in support of letters patent is:

1. A pillow and tote bag combination comprising:

a pair of cushions, each having a first face, a second face, and an outer edge, each cushion being configured and dimensioned such that said outer edges of said cushions are substantially aligned when said cushions are brought together with said first faces in contact;

attachment means for releasably attaching said cushions together with said first faces in substantially parallel relationship; and a flexible tubular sheath, with first and second ends and a hollow interior, interconnected between said cushions with said first end interconnected to one of said cushions and with said second end interconnected to the other of said cushions to form a substantially hollow enclosure, with said first face of each of said cushions toward the interior of said sheath, said sheath including an access opening between said first and second ends thereof and said sheath further including closure means for releasably closing said access opening.

2. The pillow and tote bag combination of claim 1, wherein each of said cushions includes a filler material and a cover fully enclosing said filler material.

3. The pillow and tote bag combination of claim 2, wherein said filler material is a foam material.

4. The pillow and tote bag combination of claim 2, wherein said filler material is a fibrous material.

5. The pillow and tote bag combination of claim 2, wherein said filler material is buoyant with respect to water, said cover is constructed of a material resistant to the passage of water therethrough, wherein said sheath is constructed of a material resistant to the passage of water therethrough, and wherein said closure means is resistant to the passage of water therethrough when said closure means is closed.

6. The pillow and tote bag combination of claim 1, wherein said attachment means comprises a two part zipper assembly having first and second parts, with said first part extending around and interconnected to one of said cushions at said outer edge thereof, and with said second part extending around and interconnected to the other of said cushions at said outer edge thereof.

7. The pillow and tote bag combination of claim 6, wherein each end of said sheath is interconnected to the respective one of said cushions associated therewith at said outer edge of said cushion with the respective part of said zipper assembly exterior to said sheath.

8. The pillow and tote bag combination of claim 1, wherein each of said first faces of said cushions is substantially planar.

9. The pillow and tote bag combination of claim 8, wherein each of said second faces of said cushions is convex.

10. The pillow and tote bag combination of claim 1, wherein said sheath further includes handle means interconnected to said sheath between said first and second ends thereof.

11. The pillow and tote bag combination of claim 1, wherein said closure means of said sheath comprises a zipper.

12. A pillow and tote bag combination comprising:

an elongate tubular sheath having first and second ends, a hollow interior, and a longitudinal axis, including an elongate access opening from the exterior of said sheath to the interior thereof extending parallel to said longitudinal axis of said sheath through a majority of the length between said first and second ends, including closure means for releasably closing said access opening, and further including handle means interconnected to the exterior of said sheath between said first and second ends thereof;

a first cushion having a first face and a second face and an outer edge, with the distance across said first face thereof approximately equal to the cross-sectional dimension of said sheath at said first end thereof, said first cushion being interconnected to said sheath around said outer edge of said first cushion at said first end of said sheath with said first face of said first cushion toward the interior of said sheath;

a second cushion having a first face and a second face and an outer edge, with the distance across said first face thereof approximately equal to the cross-sectional dimension of said sheath at said second end thereof, said second cushion being interconnected to said sheath around said outer edge of said second cushion at said second end of said sheath with said first face of said second cushion toward the interior of said sheath; and attachment means disposed around and interconnected to said outer edges of said cushions for releasably interconnecting said first and second cushions together with said sheath collapsed and disposed between said first faces of said cushions.

13. The pillow and tote bag combination of claim 12, wherein said closure means of said sheath comprises a zipper, and wherein said attachment means comprises a zipper.

14. A method of making and using a pillow and tote bag combination, comprising the steps of forming a pair of cushions, each having a first face, a second face and an outer edge, and providing said cushions with releasable attachment means for attaching said cushions together with their first faces together;

forming a flexible hollow sheath, having a first end and a second end, having one or more handles disposed between said first and second ends, and further having an access opening between said first and second ends;

interconnecting said sheath between said outer edges of said cushions with said first end of said sheath connected to one of said cushions and with said second end of said sheath connected to the other of said cushions such that said sheath extends between said cushions with said first faces of said cushions facing each other;

collapsing said sheath between said first faces of said cushions and bringing said first faces of said cushions together with said sheath disposed therebetween;

attaching said cushions together with said attachment means, with said sheath disposed between said cushions, thereby forming a pillow;

releasing said attachment means to release said cushions from attachment to each other; and separating said cushions and extending said sheath from a collapsed position between said cushions to an extended position between said cushions, thereby forming a tote bag with said sheath being the body of the tote bag.

15. The method of claim 14, further comprising pulling at least one handle of said sheath from between said cushions as said cushions are brought together and attaching said cushions with said handle(s) extending outwardly from between said cushions, thereby providing a handle for said pillow.

* * * * *